United States Patent [19]

Stevens

[11] Patent Number: 4,779,544

[45] Date of Patent: Oct. 25, 1988

[54] SOLID FUEL COMBUSTION ASSEMBLY

[75] Inventor: David L. Stevens, Laclede, Id.

[73] Assignee: Enerpel, Inc., Lewiston, Id.

[21] Appl. No.: 126,626

[22] Filed: Nov. 30, 1987

[51] Int. Cl.[4] ..... F23K 3/14; F23K 3/16

[52] U.S. Cl. ..... 110/110; 110/288

[58] Field of Search ..... 110/288, 110

[56] References Cited

U.S. PATENT DOCUMENTS

| | | | |
|---|---|---|---|
| 707,364 | 8/1902 | Smead | 110/288 |
| 1,709,464 | 4/1929 | Crawford | 110/108 |
| 1,874,390 | 8/1932 | Troup | 110/104 |
| 2,123,163 | 6/1938 | Birkenbeuel | 110/162 |
| 2,378,376 | 6/1945 | Ackron | 110/288 |
| 3,289,620 | 12/1966 | Heilala | 110/288 |
| 3,311,074 | 3/1967 | Margetts | 110/288 |
| 4,385,566 | 5/1983 | Harris | 110/110 |
| 4,426,937 | 1/1984 | Sietmann et al. | 110/288 |
| 4,516,511 | 5/1985 | Kuo | 110/346 |
| 4,543,890 | 10/1985 | Johnson | 110/102 |
| 4,559,882 | 12/1985 | Dobson | 110/254 |
| 4,565,184 | 1/1986 | Collins et al. | 126/368 |
| 4,619,209 | 10/1986 | Traeger et al. | 110/110 |
| 4,639,553 | 12/1986 | Goetzman | 110/214 |

*Primary Examiner*—Edward G. Favors

*Attorney, Agent, or Firm*—Paul F. Horton

[57] ABSTRACT

A solid fuel combustion assembly for use with pellet fuel and having a hopper; an auger within an auger tube for receiving fuel from the hopper and conveying it to a burnpot; a burnpot having a tubular fuel conduit fed by the auger at one end and terminating in a top opening to define a primary combustion chamber at the other; and a dome, with or without a top opening, mounted over and about the fuel conduit to define a secondary combustion chamber. A jacket surrounding the auger tube and the fuel conduit defines an air chamber having an opening to atmosphere, adjacent the auger. A plurality of peripherally spaced apertures opening into the fuel conduit from the air chamber, adjacent the top opening of the fuel conduit, provides a primary air source for the primary combustion chamber and a plurality of like apertures, opening through the jacket and under the dome provide a secondary air source of the secondary combustion chamber. A reactor plate mounted over the dome, when the dome is provided with a top opening, assists in secondary combustion.

10 Claims, 2 Drawing Sheets

SOLID FUEL COMBUSTION ASSEMBLY

BACKGROUND OF THE INVENTION

1. Field of the Invention

This invention relates to burners for pelletized fuel and, more particularly, to burners having primary and secondary combustion chambers.

2. Description of the Prior Art

In an effort to maximize efficiency of stoves and furnaces and to minimize the amount of ash, smoke, and residue, numerous devices have been invented. Basically, such devices provide a stoker; sources of air for combustion; a burner; radiator; and a gas exhaust. Primary and secondary combustion chambers have also heen provided for superior efficiency.

Examples of such devices are typified by U.S. Pat. Nos. 4,543,890; 4,559,882; and 4,630,553.

SUMMARY OF THE INVENTION

The present invention provides a solid fuel combustion assembly in which solid fuel pellets are automatically fed by means of an auger to a primary combustion chamber where hot air is supplied to the fuel through a number of peripherally spaced apertures surrounding the fuel. Any unburned gases rise into a space below an over positioned dome which completely surrounds the primary chamber. A second source of hot air is supplied to the heated gases, for essentially complete secondary combustion, through a plurality of peripherally spaced apertures located in a jacket about which the dome is spaced. The jacket apertures are upwardly and laterally angled to provide a vortex of air for superior mixing and burning of the gases. The dome is provided with a central top opening through which the gases flow. A horizontally oriented reactor plate vertically spaced over the dome opening superheats the mixture and causes the gases to fan laterally outward, aiding combustion. The plate also serves to cause downward displacement of any ash which might be carried with the gas flow, for collection.

The air source for both primary and secondary combustion travels through a chamber surrounding a portion of the auger tube and the fuel conduit, serving to cool the auger tube and hence the auger within and serving to heat the air for superior combustion.

Additional objects and advantages will become apparent and a more thorough and comprehensive understanding may be had from the following description taken in conjunction with the accompanying drawings forming a part of this specification.

DETAILED DESCRIPTION OF THE INVENTION

Figure 1:
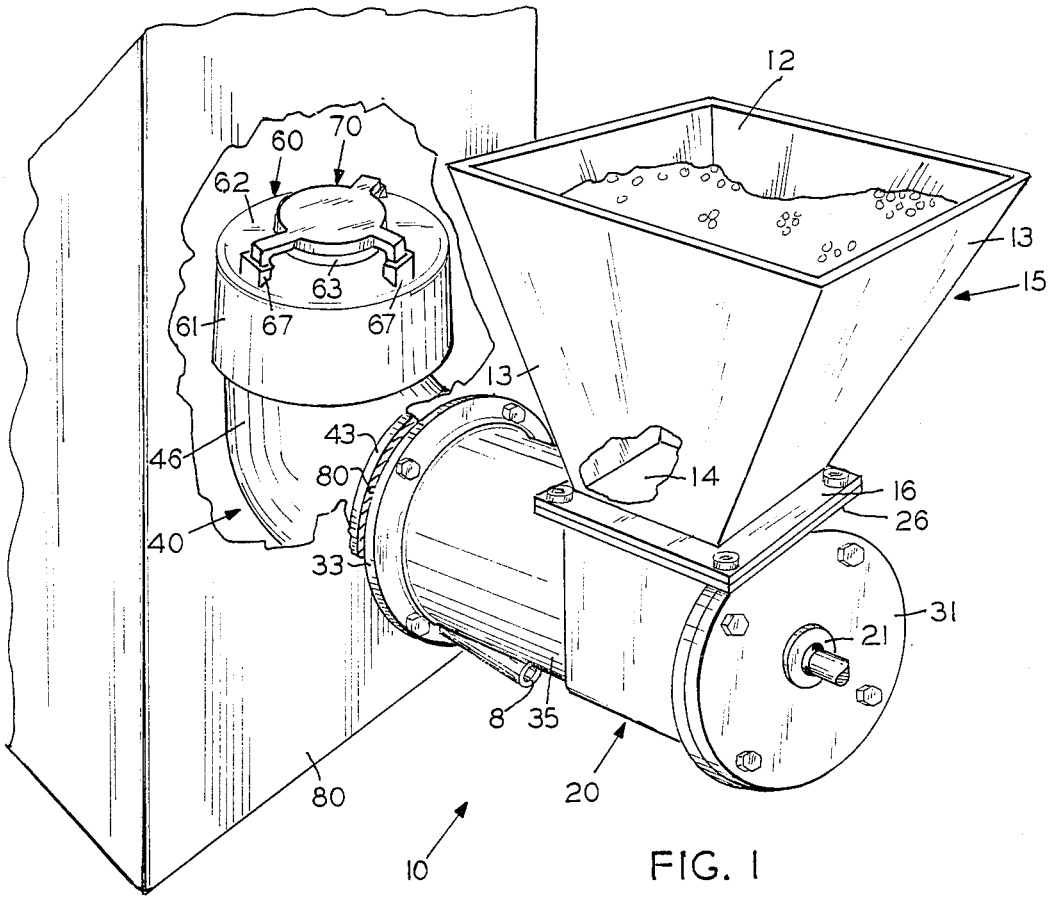
FIG. 1 is a perspective view showing the combustion assembly of the present invention.

Referring now to the drawings, and, more particularly, to FIG. 1, an embodiment to be preferred of a solid fuel combustion assembly 10, made according to the present invention, is disclosed. Assembly 10 includes a hopper 15; auger feed means, designated generally by the numeral 20; a burnpot 40; a dome 60; and a reactor plate 70.

Hopper 15 may be of any desired size and shape and may be any of existing hoppers conventional in the art. The hopper has a top opening 12 for filling of the hopper with fuel pellets; sidewalls 13; and a bottom opening 14.

Figure 2:
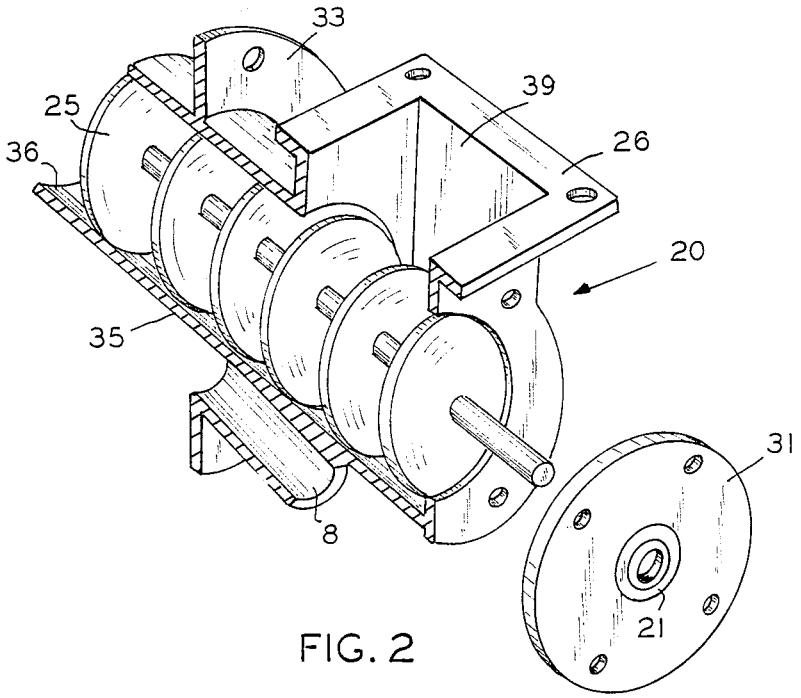
FIG. 2 is a partial sectional perspective and exploded view of the auger feed mechanism of the present invention.
Figure 3:
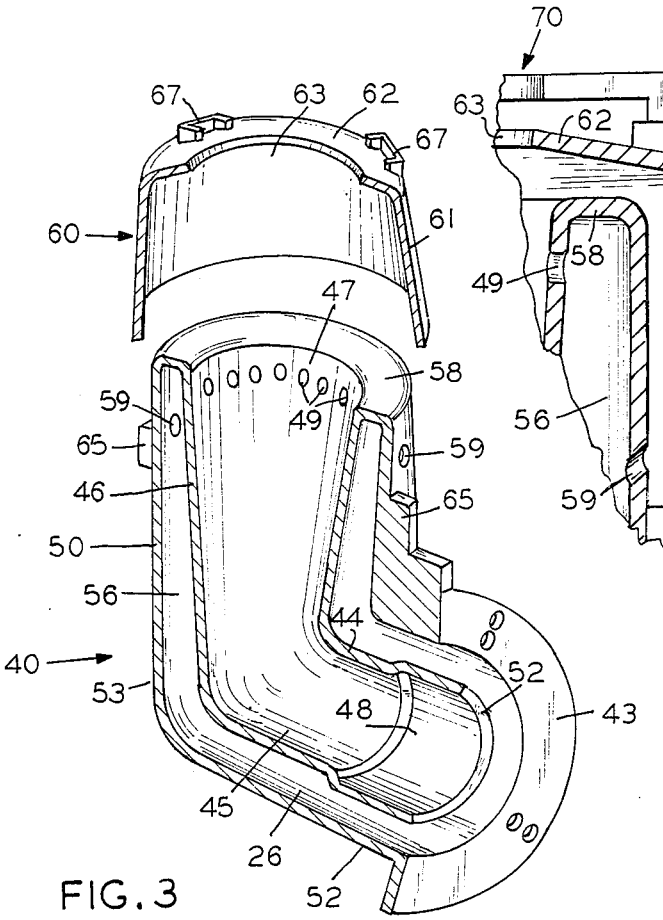
FIG. 3 is a sectional perspective view of the burnpot of the present invention and the dome in an elevated position.

Referring now to FIGS. 2 and 3, taken in conjunction with FIG. 1, auger feed means 20 is shown to advantage. The auger feed means is attached to hopper 15 by means of flange 16 of the hopper and flange 26 of the feed means, which are bolted in registry with one another. Feed means 20 includes a laterally extending auger tube 35, circular in cross section, and having a top opening 39 which is operable to receive fuel pellets from overlying hopper 15 through bottom opening 14 of the hopper. Closing the end of auger tube 35, adjacent the hopper, is a cover plate 31 which is bolted to end flange 32 of the auger tube. Cover plate 31 is provided with a support bearing 21 for auger 25. Auger 25, shown in part in FIG. 2, is cantilevered and is driven from an external drive member, not shown. The auger serves to convey fuel pellets received from the hopper into tubular fuel conduit 45 of burner 40.

Auger means 20 is mounted to burner 40 by means of flange 33, which extends radially outward from the exterior surface of the auger tube, and by a mating flange 43 of the burner, which are bolted in registry with one another. Free end 36 of auger tube 35 is thereby inserted into sleeve 48 of the burner so as to be coaxial and co-extensive with fuel conduit 45 of the burner, as may be seen in FIG. 3.

Spaced from and encompassing auger tube 35 and fuel conduit 45 is a jacket 50, which includes an auger portion 52 and a burner portion 53; the jacket being integral in construction. Auger portion 52 in cooperation with sleeve 48, and auger tube 35 contained therein, defines an air chamber 26; and burner portion 53, which is joined with and sealingly engages fuel conduit 45 at the uppermost end thereof, being spaced from and encompassing fuel conduit 45 of the burner, defines an air chamber 56 which is coextensive with air chamber 26 for conducting air for combustion from an air intake port 8 opening through flange 33 into the air chambers, as may be seen in FIG. 2 when taken with FIG. 3.

Burnpot 40 is located within a furnace or stove housing 80, shown in partial section in FIG. 1, and not a part of the present invention. Tubular fuel conduit 45 of the burnpot is substantially L-shaped in configuration, having a lateral portion 44 in communication with auger tube 35 and in having a vertical portion 46 terminating in a top opening 47. Evenly spaced about the inner periphery of fuel conduit 45, adjacent the top opening, are a plurality of air apertures 49 opening into air chamber 56 for providing air for combustion of fuel within conduit 45. Evenly spaced about the outer periphery of jacket 50, slightly below the jacket's joinder 58 with fuel conduit 45, are a plurality of air apertures 59, also opening into air chamber 56 for providing air within the secondary air chamber of dome 60, as will hereinafter be explained.

Figure 5:
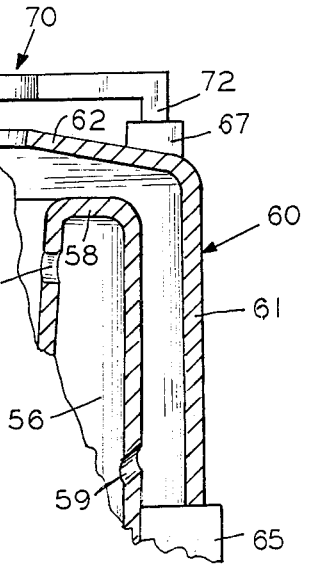
FIG. 5 is a fragmented sectional view of the dome shown mounted on the burner.

Mounted over the sides of jacket 50 and vertically spaced over the top of fuel conduit 45 is dome 60. Dome 60 rests upon horizontally oriented jacket shoulders 65, spaced about the jacket. The dome is provided with parallel interior and exterior surfaces forming a sidewall and a roof. Sidewall 61 of the dome is spaced laterally outward from the external surface of jacket 50 and roof 62 of the dome is spaced vertically over the jacket and top opening 47 of fuel conduit 45. The dome may define a central opening 63, smaller in diameter that opening 47 of conduit 45, and cooperates with the jacket and fuel conduit to define a secondary chamber within the walls and roof of the dome, as shown in FIG. 5. Opening under the dome are the air apertures 59 to provide a secondary source of air for secondary combustion of any unburned gases coming from the fuel conduit. Apertures 59 are upwardly angled at forty five degrees to force the air upward into the dome and are also laterally inclined in a given direction at a forty five degree angle relative to the external surface of the jacket to produce a vortex of air and unburned gases for superior mixing and superior combustion.

Figure 4:
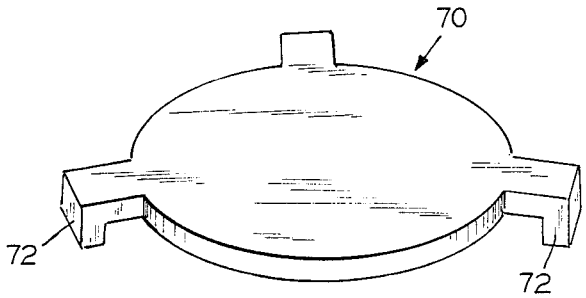
FIG. 4 is a perspective view of the reactor plate.

To assist secondary combustion, where the dome is provided with central opening 63, as is preferred, a horizontal reactor plate 70, shown to advantage in FIGS. 1 and 4, is mounted over opening 63 of dome 60. The reactor plate is provided with a plurality of pedestals 72 which engage reactor plate support platforms 67 formed on the exterior roof of the dome, to hold the plate in a vertically spaced position above the dome. In such a position, the reactor plate is superheated from the upwardly flowing, high temperature gases. Such gases, together with the hot air swirling from apertures 59, flowing through opening 63 of the dome, impinge on the superheated reactor plate and are thus fanned laterally outward by the reactor plate. Contact between unburned gases and the high temperature reactor plate together with an increased burning area, finalize combustion. The reactor plate also serves to cause a downward displacement of any ash carried by the flowing gases, to deposit the ash for collection. The reactor plate may be reversed to effectively close the top opening.

In operation, fuel pellets contained within hopper 15 are dispensed downwardly into auger tube 35 and are conveyed by auger 25, at a controlled rate, into fuel conduit 45 of burner 40. The fuel pellets are pushed upwardly toward top opening 47 by the auger. Air flowing through air intake port 8 cools sleeve 48, auger tube 35, and hence auger 25, and continues through air chambers 26 and 56, where the air is heated, exiting through peripheral apertures 49 of fuel conduit 45 to support combustion of the ignited fuel in the primary combustion chamber defined by the fuel conduit tube. Exhaust gases and any unburned gases continue to flow upwardly into the spaced defined between the dome and the jacket, where the gases meet the vortex of hot air venting from the upwardly and laterally inclined apertures 59 of jacket 50 for secondary combustion. Where the dome is without top opening, the gases are ultimately forced downward about the lower edge of the dome, before again rising. Where the dome is provided with a top opening, the gases exit therethrough. When reactor plate 70 is in place, gases and air exiting though opening 63 of the dome spiral upward where they strike the reactor plate to complete combustion.

Having thus described in detail a preferred selection of embodiments of the present invention, it is to be appreciated and will be apparent to those skilled in the art that many physical changes could be made in the apparatus without altering the inventive concepts and principles embodied therein. The present embodiments are therefore to be considered in all respects as illustrative and not restrictive, the scope of the invention being indicated by the appended claims rather than be the foregoing description, and all changes which come within the meaning and range of equivalency of the claims are therefore to be embraced therein.

I claim:

1. A solid fuel combustion assembly comprising:

a hopper for dispensing solid fuel;

auger feed means for receiving fuel from said hopper and feeding the fuel to a burnpot;

a burnpot including a tubular fuel conduit, said fuel conduit at one end connected to said auger feed means for receiving fuel therefrom and at the other end having a top opening; said fuel conduit provided adjacent the top opening with one or more air conduits for receiving combustion air therethrough to define a primary combustion chamber; and a dome mounted on said burnpot and spaced from said burnpot to define a secondary combustion chamber operable to receive vaporized fuel from said primary combustion chamber and air from atmosphere for combustion and said dome defining with said burnpot an annular bottom opening for the downward flow of gases from and about said dome.

2. The assembly as described in claim 1 wherein said dome is provided with a top opening for conduction of gases.

3. The assembly as described in claim 2 further comprising a reactor plate mounted over and spaced from the top of said dome for forcing combustion gases laterally to aid secondary combustion and for downward displacement of ash.

4. A solid fuel combustion assembly comprising:

a hopper for dispensing solid fuel;

auger feed means for receiving fuel from said hopper and feeding the fuel to a burnpot;

a burnpot including an inner tubular fuel conduit and an outer jacket spaced from said fuel conduit and defining an air chamber, opening to atmosphere, therebetween; and fuel conduit at one end connected to said auger feed means for receiving fuel therefrom and at the other end having a top opening; said fuel conduit provided adjacent the top opening with a plurality of laterally spaced apertures, about the inner periphery of said fuel conduit, opening into said air chamber for receiving preheated combustion air therethrough to define a primary combustion chamber; said jacket sealingly engaging said fuel conduit at the top opening thereof, and said jacket provided with a plurality of laterally spaced aperatures about the outer periphery of said jacket also opening into said air chamber for receiving preheated combustion air therethrough; and a dome mounted on said burnpot and spaced from said jacket and over the top opening of said fuel conduit to define a secondary combustion chamber having an annular bottom opening for the conduction of gases, said chamber operable to receive vaporized fuel from said primary combustion chamber and preheated air from said jacket apertures for combustion.

5. The assembly as described in claim 4 wherein said dome is provided with a top opening for conduction of gases.

6. The assembly as described in claim 5 further comprising a reactor plate mounted over and spaced from the top of said dome for forcing combustion gases laterally to aid in secondary combustion and for downward displacement of ash.

7. The assembly as described in claim 4 wherein said peripheral apertures of said jacket are each angularly inclined to horizontal to create a vortex of gases within said secondary conduction chamber.

8. The assembly as described in claim 7 wherein said apertures are angularly inclined upwardly.

9. A solid fuel combustion assembly comprising:

auger feed means for receiving fuel from said hopper and feeding the fuel to a burnpot, said feed means including an auger tube; an auger rotatably mounted within said auger tube; an auger jacket spaced encompassing and spaced from said auger tube to define an air chamber; and an air conduit opening into said air chamber from atmosphere for cooling said auger tube;

a burnpot including an inner tubular fuel conduit and an outer jacket spaced from said fuel conduit and defining an air chamber therebetween, said air chamber in fluid communication with the air chamber of said auger feed means; said fuel conduit at one end connected to said auger feed means for receiving fuel therefrom and at the other end having a top opening; said fuel conduit provided adjacent the top opening with a plurality of peripherally spaced apertures opening into said burnpot air chamber for receiving preheated combustion air therethrough to define a primary combustion chamber; said jacket joined to said fuel conduit at the top opening thereof, and said jacket provided with a purality of peripherally spaced apertures also opening into said burnpot air chamber for receiving preheated combustion air therethrough;

a dome mounted on said burnpot; said dome having a top opening for conduction of gases and said dome spaced from said jacket and over the top opening of said fuel conduit to define a secondary combustion chamber operable to receive vaporized fuel from said primary combustion chamber and air from said jacket apertures for combustion; and a reactor plate mounted over said dome.

10. The assembly as described in claim 9 wherein said peripheral apertures of said jacket are upwardly and laterally inclined to normal to create a vortex of air within said secondary combustion chamber.

* * * * *